US009587795B2

(12) United States Patent
Ohsawa et al.

(10) Patent No.: US 9,587,795 B2
(45) Date of Patent: Mar. 7, 2017

(54) HEADLIGHT FOR IN-VEHICLE USE

(71) Applicant: MITSUBISHI ELECTRIC CORPORATION, Tokyo (JP)

(72) Inventors: Takashi Ohsawa, Tokyo (JP); Masato Kurahashi, Tokyo (JP); Fumihiro Minami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/901,643

(22) PCT Filed: Sep. 17, 2013

(86) PCT No.: PCT/JP2013/075023

§ 371 (c)(1),
(2) Date: Dec. 28, 2015

(87) PCT Pub. No.: WO2015/040671

PCT Pub. Date: Mar. 26, 2015

(65) Prior Publication Data

US 2016/0146417 A1 May 26, 2016

(51) Int. Cl.
*F21S 8/10* (2006.01)

(52) U.S. Cl.
CPC ..... *F21S 48/1258* (2013.01); *F21S 48/1154* (2013.01); *F21S 48/1329* (2013.01); *F21S 48/145* (2013.01)

(58) Field of Classification Search
CPC ..... F21S 48/1154; F21S 48/1258; F21S 48/1329; F21S 48/145
See application file for complete search history.

(56) References Cited

U.S. PATENT DOCUMENTS

| | | | |
|---|---|---|---|
| 2003/0214815 | A1 | 11/2003 | Ishida et al. |
| 2010/0046243 | A1 | 2/2010 | Yatsuda |
| 2013/0128584 | A1 | 5/2013 | Koike et al. |
| 2013/0188377 | A1 | 7/2013 | Konishi |
| 2015/0219300 | A1 | 8/2015 | Kishi et al. |

FOREIGN PATENT DOCUMENTS

| | | | |
|---|---|---|---|
| CN | 1456837 | A | 11/2003 |
| JP | 2009-104933 | A | 5/2009 |
| JP | 2010-49886 | A | 3/2010 |
| JP | 2012-190551 | A | 10/2012 |
| JP | 2013-73811 | A | 4/2013 |
| JP | 2013-110005 | A | 6/2013 |
| JP | 2013-152813 | A | 8/2013 |

*Primary Examiner* — Thomas M Sember
(74) *Attorney, Agent, or Firm* — Birch, Stewart, Kolasch & Birch, LLP

(57) ABSTRACT

In a headlight for in-vehicle use, an LED serving as an optical source is provided in which one edge side of its light-emitting face is formed into a linear portion and placed at a side of an optical axis so that the center of the light-emitting face is displaced from the optical axis. A projection lens is constituted by a radiation-side convex lens and an LED-side convex lens that are arranged in a direction of the optical axis. Between the LED and the projection lens, a light distribution member is placed that is formed using a transparent material and has, on its inner surface, a reflection face for reflecting light emitted by the LED.

12 Claims, 7 Drawing Sheets

HEADLIGHT FOR IN-VEHICLE USE

TECHNICAL FIELD

The present invention relates to a headlight for in-vehicle use in which an LED is used as an optical source and a projection lens is provided that projects light emitted by the LED ahead of a vehicle.

BACKGROUND ART

Under tendency to reduce the amount of emission of carbon dioxide that promotes global warming, and in recent/current situation in which bright LEDs with high luminous efficiency are realized, low-power LEDs (light emitting diodes, semiconductor optical sources) are beginning to be popular also as optical sources of lamp devices for in-vehicle use, in place of conventional tungsten filament-based light bulbs. These LEDs are long-life and can produce stable brightness under easy control that makes constant a current supplied thereto, and are thus, well-suited as optical sources of lamp devices for in-vehicle use. Thus, also with the help of recent increase in output power (luminance intensity), they are beginning to be popular also as optical sources of the headlights for in-vehicle use.

Meanwhile, the optical systems of the headlights for in-vehicle use are classified to: a parabolic type in which a concave mirror reflector is used and the light emitted by an optical source is reflected by the mirror reflector so as to go out ahead of the vehicle; and a projector type in which a convex projection lens is used and the light emitted by an optical source is refracted by the projection lens so as to go out ahead of the vehicle.

In the followings, supplemental description will be made about configurations of the projector-type headlights for in-vehicle use that are related to the invention of this application.

In a conventional configuration that uses a tungsten filament as an optical source, lead wires are connected to both ends of the filament with a length of about 4 mm that radiates light all around, and in addition, a glass bulb exists outward of the filament. Thus, it is unable to arbitrarily modify the shape of a light emitting portion or the light radiation direction.

For that reason, a spheroidal mirror reflector is used and a filament serving as an optical source is placed at one focal point of the spheroidal mirror reflector, so that the light emitted by the filament is converged at the other focal point to thereby form a real image of the filament. Since no structural object exists near the real image of the filament, an arbitrary optical member can be used there, so that a light distribution for passing light for in-vehicle use that illuminates the front of a vehicle is formed by projecting ahead of the vehicle a necessary portion in the light that passes through the real image of the filament. That is to say, a light shielding plate is placed near the real image of the filament, so that unwanted light is blocked by the light shielding plate to thereby form a dark portion that is essential for passing light so as not to illuminate the driver of an oncoming vehicle. Namely, when an optical source is the filament in a state covered by the glass bulb without change, it is unable to be used as an optical source that radiates a light distribution for passing light. Thus, such a configuration is applied in which the real image of the filament around which no structural object exists is forcibly formed using the spheroidal mirror reflector, and the real image of the filament is subjected to shape modification, and then guided into the projection lens.

However, with respect to a projector-type headlight for in-vehicle use in which the above-described LED is used as an optical source, a light emitting portion, that is, a light emitting face of the LED can be formed into an arbitrary shape, and no glass bulb exists outward. Thus, it is also allowable to place a member for adjusting the light distribution near the LED. Namely, with respect to the projector-type headlight for in-vehicle use in which the LED is used as an optical source, it is unnecessary to follow the conventional optical system and light distribution technology in which a tungsten filament is used.

In the followings, examples will be described about the headlight for in-vehicle use that does not use a conventional spheroidal mirror reflector even though it is a projector type, and that is configured so that the light-emitting face of the LED is directed ahead of the vehicle and the light emitted by the LED is made directly incident on the projection lens.

A direct-projection type lamp device for illumination according to Patent Document 1 is configured so that, in the light emitted by the LED, widely-spread light that is non-incident on a projection lens is recovered using an auxiliary lens placed around the LED. Because of the use of the auxiliary lens, the light-beam utilization rate can be enhanced.

However, since it is configured so that the light that is non-incident on the projection lens is guided ahead of the vehicle while bypassing the projection lens, the auxiliary lens that is larger than the aperture of the projection lens is used. As the result, the opening portion of the lamp device is larger, so that the device is not suited as a compact headlight or optical member.

A lamp unit for vehicle according to Patent Document 2 is configured with a light-scattering optical face provided at the rear focal point of a projection lens in order to mitigate unevenness (illuminance unevenness) of light emitted by an LED optical source composed of a plurality of LEDs, wherein light emitted by each of the LEDs is caused to pass through the optical face to be combined together, and is then guided into the projection lens. The illumination light having been projected through scattering by that lens face, becomes optically uniform.

For example in FIG. 1, etc. of Patent Document 2, there is illustrated a configuration in which a projection lens (20) is composed of a plurality of lenses (21, 22); a face (S1) of the lens (21) closest to an optical source unit (30) is formed into a shape for scattering light; and this lens face (S1) is placed to be matched to the rear focal point of the projection lens (20).

Further, for example in FIG. 5, FIG. 6, etc. of Patent Document 2, there is illustrated a configuration in which a cylindrical light guide member (32) whose inside serves as a reflection face (31*a*) is provided between the projection lens (20) and the optical source unit (30); the face (S1) of the lens (21) closest to the optical source unit (30) is formed into a shape for scattering light; and an outlet port (31*c*) of the light guide member (32), the lens face (S1) for scattering light, and the rear focal point of the projection lens (20) are matched to the same position.

In the foregoing, the numerals in the parentheses are cited from those in Patent Document 2.

Because the surface of the projection lens is formed into a light-scattering shape as described above, it is possible to make uniform brightness produced by the respective LEDs; however, when the configuration in Patent Document 2 is used for passing light for in-vehicle use, a boundary between the upper dark portion and the lower light portion for passing light will be blurred due to the presence of the scattering face. Thus, this configuration is not suited for passing light that requires clear lightness and darkness in the upper and lower sides.

A headlight for vehicle according to Patent Document 3 is configured with a first reflection face being a planer face and a second reflection face being a curved face that are placed in the upper side and the lower side, respectively, so that an optical axis of an LED is sandwiched between them, wherein a short side of the first reflection face is matched to the focal point group of a projection lens.

For example in FIG. 8, etc. of Patent Document 3, there is illustrated an optical member (16B) in which a portion surrounded by the first reflection face (22) and the second reflection face (26) is filled with a resin (36). The light emitted by an LED optical source (12) is guided into a projection lens (14) while being reflected on the first and second reflection faces (22, 26), so that the utilization rate of the LED optical source (12) can be enhanced and a thin lamp device with a short depth can be configured (the numerals in the parentheses are cited from those in Patent Document 3).

However, the first and second reflection faces have to be subjected to surface treatment for reflection. Namely, each reflection face to be used is required to be mirror face, and in order to form such a reflection mirror, a plurality of processes, for example, a vapor deposition of a metal for reflection, an antioxidant treatment of the vapor deposited face, and the like become necessary. Accordingly, its unit price as a component rises. Further, because of the use of a plurality of components, the configuration becomes complex, so that there may also be a possibility that the assembly man-hours increase.

CITATION LIST

Patent Document

Patent Document 1: Japanese Patent Application Laid-open No. 2009-104933

Patent Document 2: Japanese Patent Application Laid-open No. 2013-73811

Patent Document 3: Japanese Patent Application Laid-open No. 2010-49886

SUMMARY OF THE INVENTION

Problems to be Solved by the Invention

As described above, the configurations of above Patent Documents 1 to 3 have both merits and demerits, so that further improvements are just desired therefor.

This invention has been made from such a viewpoint, and an object thereof is to achieve a headlight for in-vehicle use that is small-sized but can produce a sufficient brightness, and further that is simple and inexpensive.

Means for Solving the Problems

A headlight for in-vehicle use of the invention comprises: an LED that constitutes an optical source and has a light-emitting face whose one edge side is linearly formed and placed at a side of an optical axis so that the center of the light-emitting face is displaced from the optical axis; two convex lenses that are arranged in a direction of the optical axis to constitute a projection lens; and a light distribution member that is placed between the LED and the projection lens, that is formed using a transparent material and that has, on its inner surface, a reflection face for reflecting the light emitted by the LED, so as to form a cut-off line at a projection-lens-side edge of the reflection face.

Effect of the Invention

According to the invention, because the projection lens is constituted by the two convex lenses, the light emitted by the LED can be used effectively even if the respective lenses are made small in diameter, so that it is possible to achieve a headlight for in-vehicle use that is small-sized but can produce a sufficient brightness. Further, because the light distribution member is formed using a transparent material and its inner surface is used as the reflection face, it is unnecessary to apply a mirror finishing thereto, so that an inexpensive headlight for in-vehicle use can be achieved with a simple configuration.

MODES FOR CARRYING OUT THE INVENTION

Hereinafter, for illustrating the invention in more detail, embodiments for carrying out the invention will be described according to the accompanying drawings.

Embodiment 1

Figure 1:
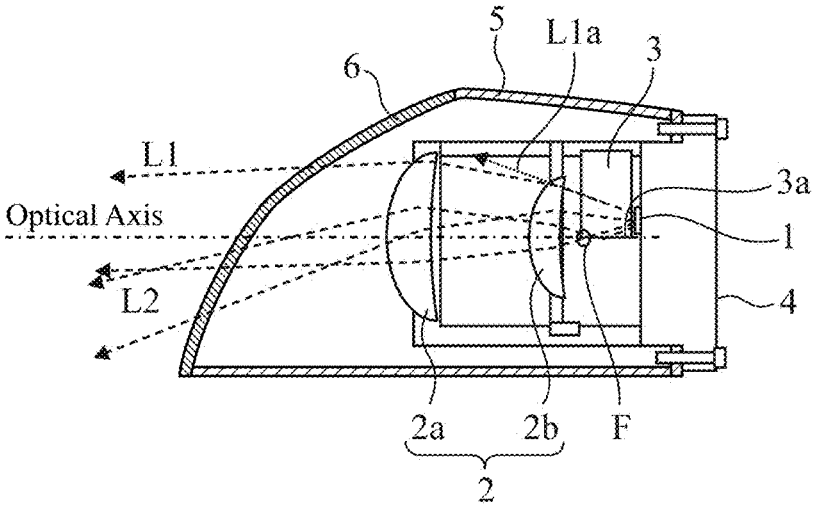
FIG. 1 is a sectional view showing a configuration example of a headlight for in-vehicle use according to Embodiment 1 of the invention.

As shown in FIG. 1, a headlight for in-vehicle use according to Embodiment 1 is an example of a projector-type headlight for passing light, and includes: an LED 1 for passing light having a light-emitting face 1*a* whose one edge side is linear and given as a linear portion 1*b*, said linear portion being placed at a side of an optical axis so that the center of the light-emitting face 1*a* is displaced from the optical axis; a projection lens 2 constituted by a radiation-side convex lens 2*a* and an LED-side convex lens 2*b* that are arranged in the direction of the optical axis; a light distribution member 3 that is placed between the LED 1 and the projection lens 2, that is formed using a transparent material and that has, on its inner surface, a reflection face 3*a* for reflecting the light emitted by the LED 1, wherein a projection-lens-side edge 3*b* of the reflection face 3*a* is placed on the optical axis; a heat-dissipation and fixing member 4 that serves as a heatsink for the LED 1 and also as a member for fixing the LED 1, the projection lens 2 and the light distribution member 3; a casing 5 that accommodates them; and a front lens 6.

The projection lens 2 as a set mainly serves such that the LED-side convex lens 2*b* converges the light emitted by the LED 1 and that the radiation-side convex lens 2*a* projects the light ahead of a vehicle. For example, if there is a lack of the LED-side convex lens 2*b*, light L1*a* going toward an upper side from the LED 1 is leaked out obliquely upward of the radiation-side convex lens 2*a* and not utilized as illumination light of the headlight. In contrast, when the LED-side convex lens 2*b* is provided, light L1 going toward an upper side from the LED 1 is refracted in the LED-side lens 2*b* to be incident on the radiation-side convex lens 2*a*, and is thus radiated ahead of the vehicle. Hence, the light emitted by the LED 1 is utilized effectively.

Because the projection lens, that has heretofore been a single lens, is constituted by two lenses of the radiation-side convex lens 2*a* and the LED-side convex lens 2*b* as shown in FIG. 1, its focal point becomes shorter. Thus, it is possible to make a face of the LED-side convex lens 2*b*, that is facing toward the LED 1, closer to a focal point F in the side of the LED 1 of the projection lens 2 as a set, so that the LED-side convex lens 2*b* can be placed in the vicinity of the LED 1 and the light distribution member 3.

Accordingly, even if small-aperture lenses are used as the projection lens 2, it is possible to reduce a leakage of the light of the LED 1 emitted over a wide range, and thus to cause the light to be effectively incident on the projection lens 2.

Figure 2:
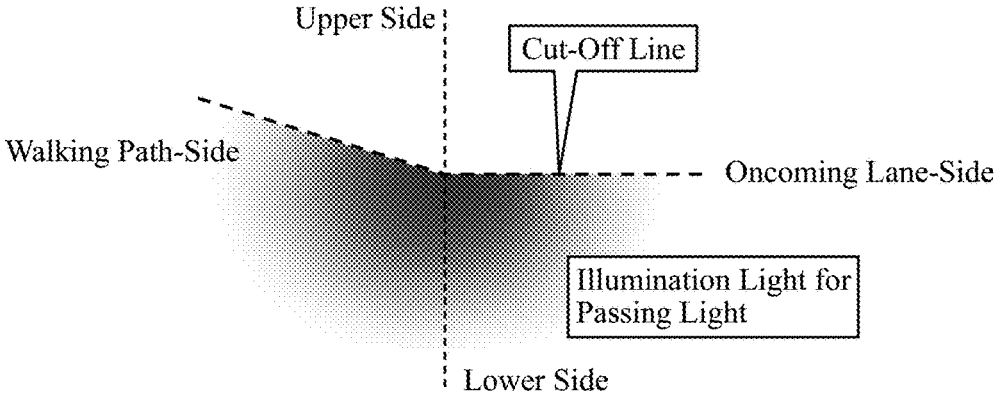
FIG. 2 is a diagram showing a condition of illumination light for passing light that is radiated from the headlight for in-vehicle use ahead of a vehicle.

FIG. 2 shows a condition of illumination light for passing light that is radiated from the headlight for in-vehicle use ahead of a vehicle, in which a bright portion of the illumination light is deeply depicted and a dark portion thereof is lightly depicted.

For the light distribution for passing light, it is essentially required to provide a dark portion at the upper side in the illumination light in order not to illuminate the driver of an oncoming vehicle, and thus it is required to darken the upper side and to lighten the lower side (road-surface side). The boundary between the upper dark portion and the lower light portion in the illumination light is a cut-off line.

Further, it is also required to brighten just below the cut-off line, namely, a portion that illuminates a place distant from the vehicle.

In order to fulfill the above requirements, the light distribution member 3 is interposed between the LED 1 and the projection lens 2. Light that is emitted toward a lower side from the LED 1 and going toward an upper side of the cut-off line through the projection lens 2, is reflected by the reflection face 3*a* of the light distribution member 3, so that the light is guided, in reverse, to just below the cut-off line (for example, L2 in FIG. 1). This darkens the upper side in the illumination light, and at the same time, brightens a portion in the lower side just below the cut-off line, to thereby form a light distribution for passing light.

Note that, in order to form the cut-off line for passing light more clearly, it is desirable that the edge side of the light-emitting face 1*a* of the LED 1, that corresponds to the linear cut-off line and is placed in the side of the optical axis, be linearly formed into the linear portion 1*b*.

In order that the edge side of the light-emitting face 1*a* of the LED 1 is linear, an LED whose light-emitting face 1*a* is rectangle may be used, or a plurality of LEDs may be used that are arranged so that their respective one sides become linear. Furthermore, as the LED 1, a semiconductor optical source, such as a laser LED, an organic LED, etc. may be used.

Figure 3:
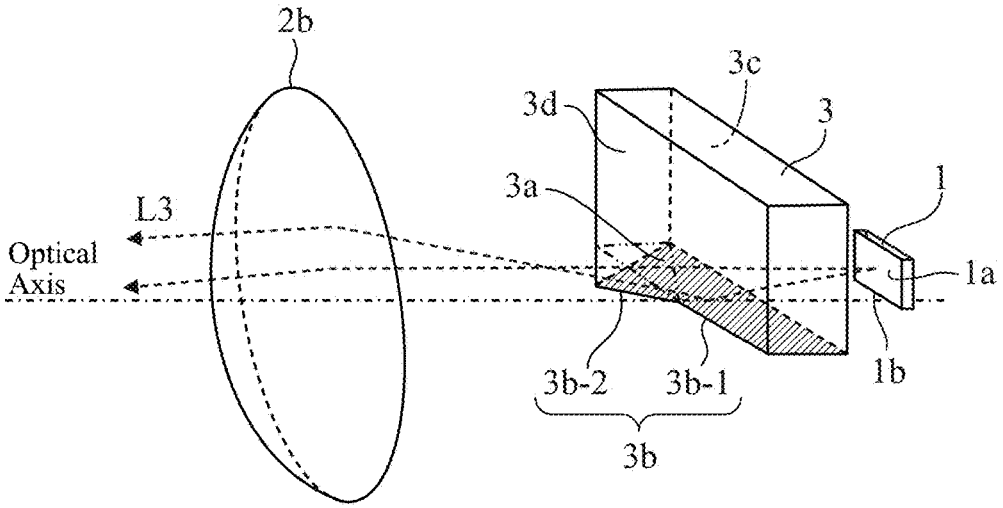
FIG. 3 is a perspective view showing a configuration by an LED, a light distribution member and an LED-side convex lens in the headlight for in-vehicle use according to Embodiment 1.

Here, in FIG. 3, a positional relationship among the LED 1, the projection lens 2 and the light distribution member 3, and an example of the shape of the light distribution member 3 are shown. In the LED 1, the light-emitting face 1*a* is made perpendicular to the optical axis, and the linear portion 1*b* of the light-emitting face 1*a* is placed at the side of the optical axis so that the center of the light-emitting face 1*a* is displaced from the optical axis.

The light distribution member 3 is formed of a transparent resin, a glass or the like, in which the reflection face 3*a* in a planar form is formed on the optical-axis side in the light distribution member 3, and the projection-lens-side edge 3*b* of the reflection face 3*a* is placed on the optical axis. An incident face 3*c* on which the light emitted by the LED 1 is incident and an outgoing face 3*d* through which the incident light goes out to the LED-side convex lens 2*b* are perpendicular to the optical axis. In such a configuration, in the light emitted from the LED 1 toward its lower side, light L3 that is incident at a shallow angle on the reflection face 3*a* inside the light distribution member 3 is totally reflected. Namely, it is possible to constitute a preferred reflection face 3*a* without applying a mirror finishing to the light distribution member 3.

Further, with respect to the example of the shape of the light distribution member 3 shown in FIG. 3, in the projection-lens-side edge 3*b* of the reflection face 3*a*, a portion in the left side as viewed ahead of the vehicle (walking path-side) is made horizontal to provide a horizontal face 3*b*-1 and a portion in the right side as viewed likewise (oncoming lane-side) is made inclined downward to provide an inclined portion 3*b*-2. Due to such a shape of the projection-lens-side edge 3*b*, as shown in FIG. 2, it is possible to form a light distribution for passing light that can illuminate up to a higher position in the left side (walking path-side) while keeping the light-dark boundary in the right side (oncoming lane-side) horizontal.

As a matter of course, in a headlight for right-hand traffic, the shape of the projection-lens-side edge 3*b* of the light distribution member 3 is right-to-left reversed, so that a portion in the right side as viewed ahead of the vehicle (walking path-side) provides a horizontal face 3*b*-1 and a portion in the left side as viewed likewise (oncoming lane-side) provides an inclined portion 3*b*-2.

As described above, radiation is made while projecting the shape of the projection-lens-side edge 3*b* of the reflection face 3*a* ahead of the vehicle using the projection lens 2, so that a light distribution for passing light is formed.

Furthermore, in order to radiate the illumination light for passing light to an area from just front of the vehicle up to a distant place with a uniform light distribution, the projection-lens-side edge 3*b* of the light distribution member 3 is placed in the vicinity of (within a predetermined distance from) the focal point F of the projection lens 2 as a set.

Here, referring to FIG. 4, an arrangement example of the focal point F of the projection lens 2 as a set will be described. A distance from an LED 1-side face of the LED-side convex lens 2*b* to the focal point F of the projection lens 2 as a set is defined as A, and a distance from the focal point F of the projection lens 2 as a set to the projection-lens-side edge 3*b* of the light distribution member 3 is defined as B.

The phrase "in the vicinity of (within a predetermined distance from)", that represents the positional relationship between the focal point F of the projection lens 2 and the projection-lens-side edge 3*b* of the light distribution member 3, means that the projection-lens-side edge 3*b* is placed nearer to the projection lens 2 or to the LED 1 within one-fifth of the distance A relative to the focal point F of the projection lens 2 (namely, $B \leq A/5$).

Preferably, it means that the projection-lens-side edge 3*b* is placed nearer to the projection lens 2 or to the LED 1 within one-tenth of the distance A relative to the focal point F of the projection lens 2 (namely, $B \leq A/10$).

More preferably, it means that the projection-lens-side edge 3*b* is placed nearer to the projection lens 2 or to the LED 1 within one-fiftieth of the distance A relative to the focal point F of the projection lens 2 (namely, $B \leq A/50$).

Figure 4:
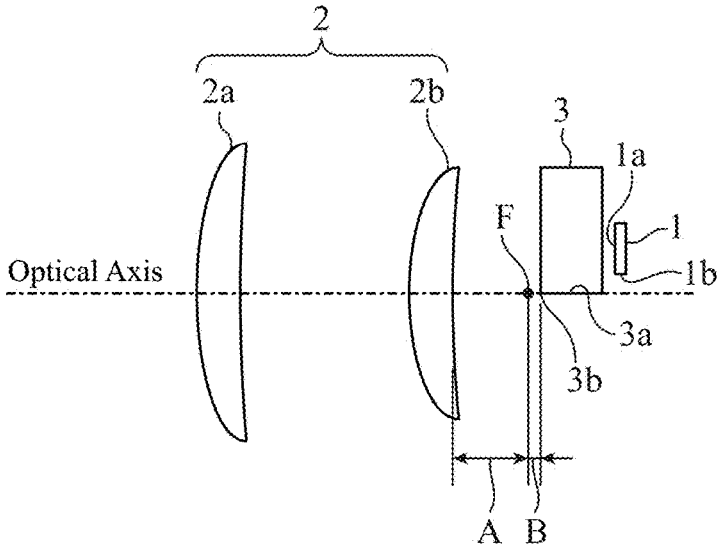
FIG. 4 is a diagram illustrating an arrangement example about a focal point F of a projection lens 2 as a set, in the headlight for in-vehicle use according to Embodiment 1.

However, in FIG. 4, only the distance B in the case of placing the projection-lens-side edge 3*b* nearer to the LED 1 relative to the focal point F of the projection lens 2 is shown, so that the distance in the case of placing the projection-lens-side edge 3*b* nearer to the projection lens 2 is not shown.

It suffices to determine the distance for placing the projection-lens-side edge 3*b* relative to the focal point F according to a demand for a light distribution of the illumination light. In this connection, when the projection-lens-side edge 3*b* of the light distribution member 3, that forms a cut-off line for passing light, is placed close to the focal point F of the projection lens 2 as a set, the cut-off line of the illumination light at a distant place ahead of the vehicle becomes clear, whereas the cut-off line of the illumination light at a nearby place of the vehicle is blurred. When the projection-lens-side edge 3*b* of the light distribution member 3 is placed apart toward the LED 1 from the focal point F of the projection lens 2 as a set, the cut-off line of the illumination light at a nearby place ahead of the vehicle becomes clear, whereas the cut-off line of the illumination light at a distant place ahead of the vehicle is blurred.

Note that, the shape of the light distribution member 3 may be other than that shown in FIG. 3 so long as it is a shape that can provide a planar face serving as the reflection face 3*a* in the side toward the optical axis. As modified examples of the light distribution member 3, FIG. 5(*a*) to FIG. 5(*f*) are shown.

Figure 5:
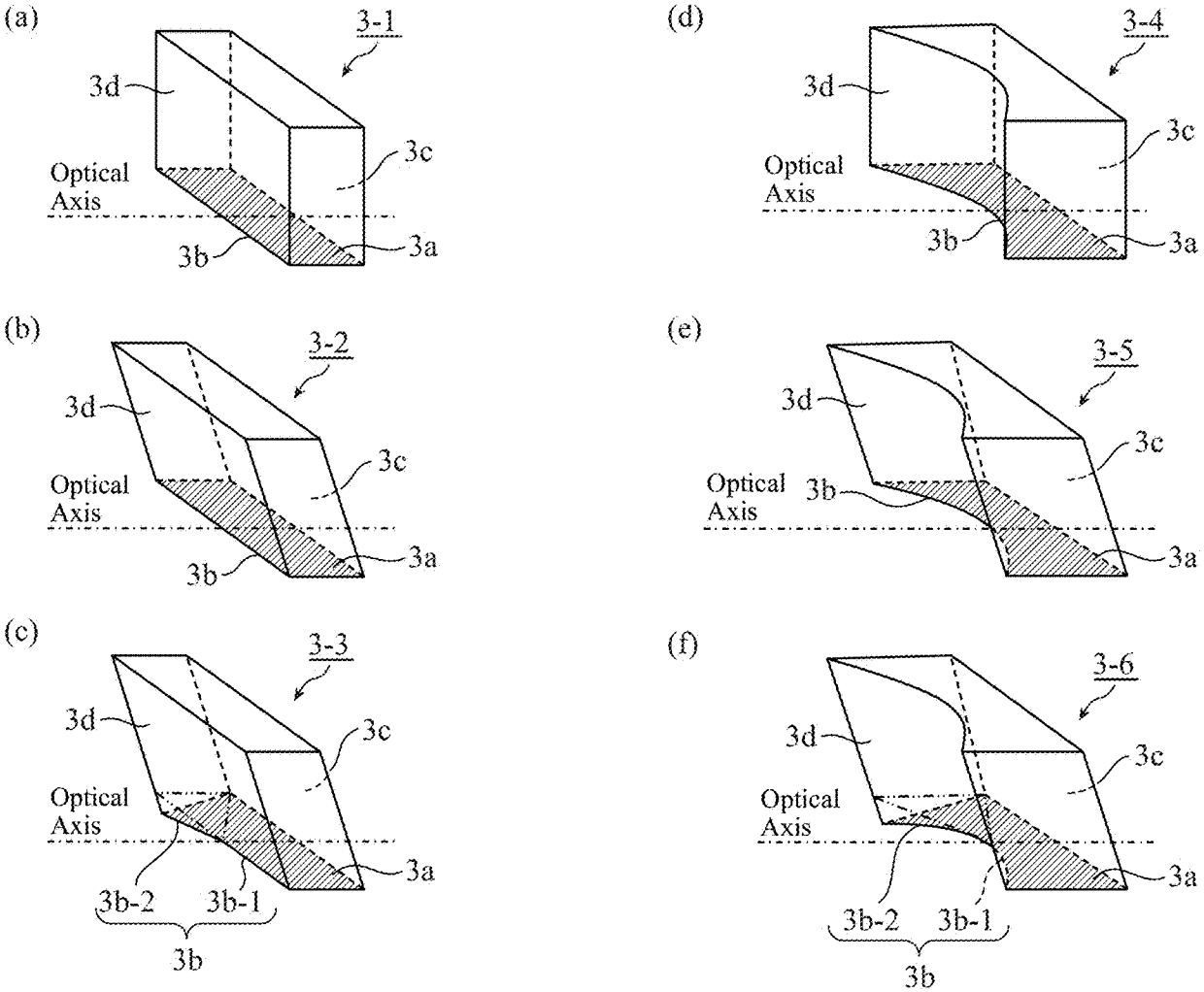
FIGS. 5 (*a*), 5(*b*), 5(*c*), 5(*d*), 5(*e*) and 5(*f*) are perspective views each showing an example of a light distribution member used in the headlight for in-vehicle use according to Embodiment 1.

A light distribution member 3-1 at FIG. 5(*a*) has a rectangular parallelepiped shape, in which a lower rectangular planar face is provided as the reflection face 3*a*. A cut-off line for passing light is formed by the projection-lens-side edge 3*b* of the lower reflection face 3*a*. The cut-off line formed by the projection-lens-side edge 3*b* of the light distribution member 3-1 is given to be linear so that its heights at the walking path-side and the oncoming road-side are the same.

A light distribution member 3-2 at FIG. 5 (*b*) has a shape obtained by inclining the incident face 3*c* and the outgoing face 3*d* of the light distribution member 3-1 shown at FIG. 5 (*a*), with respect to a plane perpendicular to the optical axis. The incident face 3*c* and the outgoing face 3*d* are inclined to be more toward the unshown projection lens 2 as a distance thereof increases from the optical axis. Because the light distribution member 3-2 is inclined so that its upper portion apart from the optical axis is more toward the projection lens 2 in such a manner, the light emitted by the LED 1 can be refracted at the incident face 3*c* and the outgoing face 3*d* to be guided toward the optical axis, so that it becomes unnecessary to place the linear portion 1*b* of the light-emitting face 1*a* of the LED 1 to abut on the optical axis.

In other words, the linear portion 1*b* of the light-emitting face 1*a* of the LED 1 can be placed apart from the optical axis.

A light distribution member 3-3 at FIG. 5(*c*) is that obtained by inclining downward a right-side (oncoming lane-side) edge in the reflection face 3*a* of the light distribution member 3-2 shown at FIG. 5(*b*), as similar to the light distribution member 3 shown in FIG. 3, to form the inclined portion 3*b*-2.

A light distribution member 3-4 at FIG. 5(*d*) is that obtained by forming the outgoing face 3*d* of the light distribution member 3-1 shown at FIG. 5(*a*) into a curved shape so that the projection-lens-side edge 3*b* is formed into a circular arc shape. When, due to aberration of the projection lens 2, a focal point-equivalent line (focal point group) where the light passing through the projection lens 2 becomes parallel light, is not given as a straight line perpendicular to the optical axis but is given with a circular arc shape, the light distribution member 3-4 is used in which the projection-lens-side edge 3*b* of the same circular arc shape is formed. Due to the shape of the projection-lens-side edge 3*b*, it is possible to form light-dark portions in the upper and lower sides while making clear the cut-off line over a wide range from the center of the vehicle toward the right and left sides.

A light distribution member 3-5 at FIG. 5(*e*) has a shape obtained by inclining the incident face 3*c* and the outgoing face 3*d* of the light distribution member 3-4 shown at FIG. 5(*d*) with respect to a plane perpendicular to the optical axis, as similar to in FIG. 5(*b*).

A light distribution member 3-6 at FIG. 5(*f*) is that obtained by inclining downward a right-side (oncoming lane-side) edge of the reflection face 3*a* of the light distribution member 3-5 shown at FIG. 5(*e*), as similar to the light distribution member 3 shown in FIG. 3, to form the inclined portion 3*b*-2.

Not that, in FIG. 5(*b*), FIG. 5(*c*), FIG. 5(*e*) and FIG. 5(*f*), although both of the incident face 3*c* and the outgoing face 3*d* are inclined toward the projection lens 2, only either one of them may be inclined instead.

Figure 6:
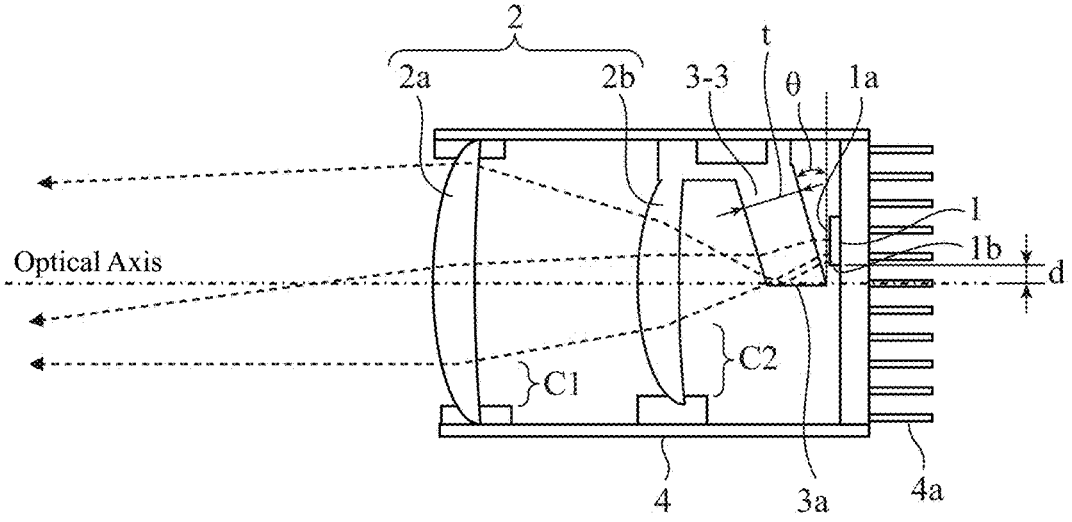
FIG. 6 is a side view showing a modified example of an optical system of the headlight for in-vehicle use according to Embodiment 1.

Here, a configuration example of an optical system that uses the light distribution member 3-3 at FIG. 5(*c*) is shown in FIG. 6. Since the light distribution member 3-3 refracts to guide the light emitted by the LED 1 toward the optical axis, the linear portion 1*b* of the light-emitting face 1*a* of the LED 1 can be placed apart from the optical axis.

When it is necessary to take a large separation interval d between the linear portion 1*b* of the LED 1 and the optical axis, an inclined angle θ of the light distribution member 3-3 is made larger or a thickness t of the light-emitting face 3-3 is made thicker so that the light emitted by the LED 1 is refracted largely toward the optical axis, to thereby make the apparent liner portion 1*b* of the LED 1 as if it were closer to the optical axis.

Meanwhile, in the configuration example in FIG. 6, a heat-dissipation fin 4*a* for dissipating heat generated by the LED 1 is mounted on the heat-dissipation and fixing member 4. The heat-dissipation fin 4*a* may be exposed to the outside of the casing 5 to thereby achieve enhancement in heat-dissipation ability.

In addition, in the configuration example in FIG. 6, the radiation-side convex lens 2*a*, the LED-side convex lens 2*b* and the light distribution member 3-3 are formed of the same material (for example, an acrylic resin), and the LED-side convex lens 2*b* and the light distribution member 3-3 are molded integrally.

When the LED-side convex lens 2*b* and the light distribution member 3-3 are molded integrally, both of them are mutually fixed. Further, the LED-side convex lens 2*b* and the light distribution member 3-3 can be fabricated using the same material by a common process, so that a component member therefrom can be achieved that is highly accurate in their mutual positions and is low in cost. Furthermore, the configuration in which the incident face 3*c* and the outgoing face 3*d* of the light distribution member 3-3 are inclined, is favorable for a mold used for molding the LED-side convex lens 2*b* and the light distribution member 3-3 integrally, to ensure its draft angle.

In FIG. 6, in the projection lens 2 and under the optical axis, there are portions C1, C2 where the light emitted by the LED 1 does not reach due to interruption by the reflection face 3*a* of the light distribution member 3-3. The portions C1, C2 of the convex lenses where the light does not reach are useless and are optically non-problematic even if they are eliminated. Accordingly, the portions C1, C2 where the light does not reach may be eliminated.

Figure 7:
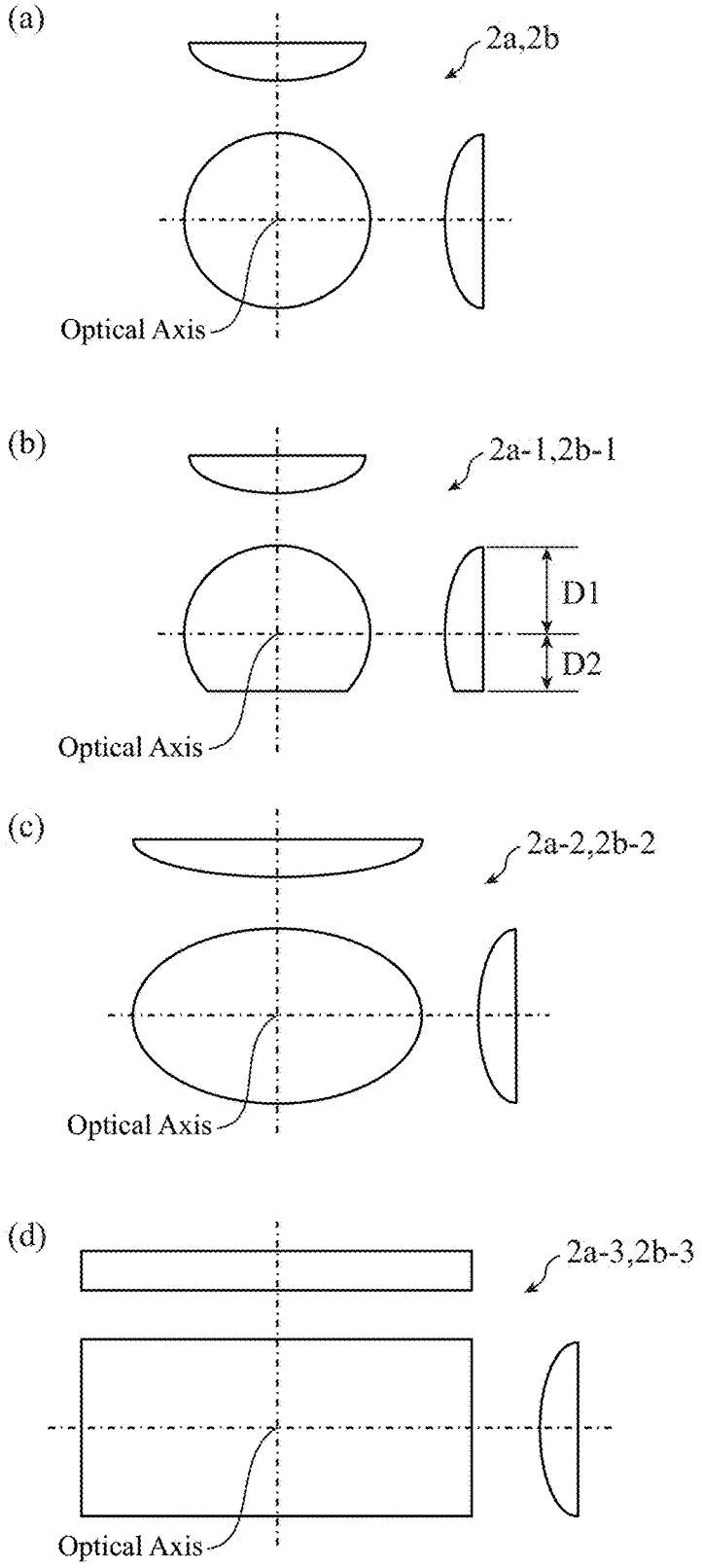
FIGS. 7 (*a*), 7(*b*), 7(*c*), and 7(*d*) are three-sided views each showing an example of the light distribution member used in the headlight for in-vehicle use according to Embodiment 1.

Here, in FIG. 7, examples of a convex lens that is usable as the radiation-side convex lens 2*a* or the LED-side convex lens 2*b* are shown. The convex lens shown as three-sided views at FIG. 7(*a*) is a standard convex lens whose one side is a convex face and the other side is a planar face. By using this convex lens as the radiation-side convex lens 2*a* or the LED-side convex lens 2*b*, lightness and darkness in the upper and lower sides of the cut-off line are produced due to refraction in up-down direction of the convex lens; the illumination light of the headlight is spread right and left due to refraction in right-left direction of the convex lens; and an inclined cut-off line is provided as being formed due to the inclined portion 3*b*-2.

Note that the standard convex lens of FIG. 7(*a*) serves to converge the light emitted by the LED 1 to the center (toward the optical axis) and thus, it is suited, in particular, to be used as the LED-side convex lens 2*b*.

Figure 8:
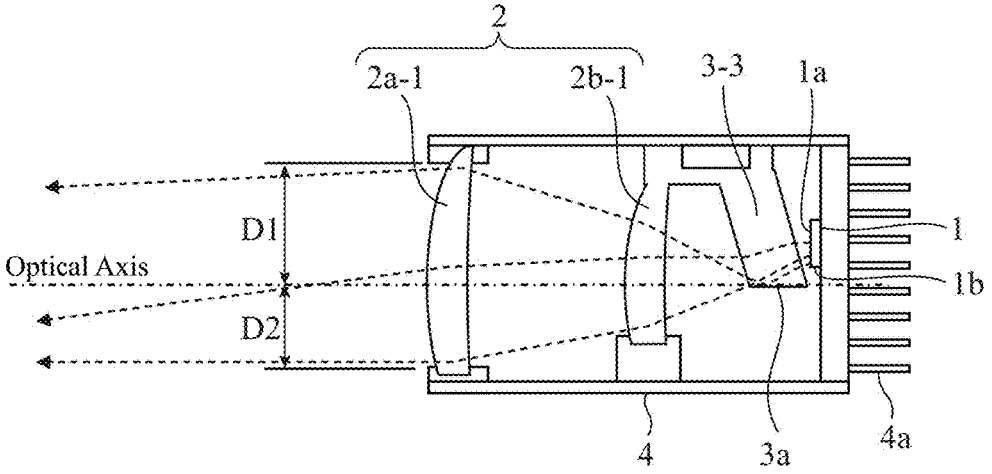
FIG. 8 is a side view showing another modified example of the optical system of the headlight for in-vehicle use according to Embodiment 1.

The convex lens of FIG. 7(*b*) has a shape that is obtained by eliminating from the standard convex lens shown at FIG. 7(*a*), the portion C1 or C2 (namely, a part in the side lower than the optical axis) where the light does not reach as described using FIG. 6, to thereby make a lower side D2 from the optical axis smaller than an upper side D1 therefrom. As shown in FIG. 8, this convex lens can be used as a radiation-side convex lens 2*a*-1 or an LED-side convex lens 2*b*-1. This makes it possible to downsize the headlight for in-vehicle use in up-down direction.

In the headlight for in-vehicle use, with respect to the convex lens used as the radiation-side convex lens 2*a* or the LED-side convex lens 2*b*, it is not necessarily required to make equivalent its vertical refraction amount to its horizontal refraction amount as in FIG. 7(*a*), and thus, the lens may be a convex lens with an elliptical shape as shown at FIG. 7(*c*) or a convex lens in a semicircular-column shape as shown at FIG. 7(*d*).

When a curvature of the lens face is large, the passing light is largely refracted at the lens face, so that a convex lens with a short focal distance is formed. In contrast, when a curvature of the lens face is small, the refraction amount of the passing light is small, so that a convex lens with a long focal distance is formed.

By using, as a radiation-side convex lens 2*a*-2, a convex lens with an elliptical shape in which the curvature in up-down direction is larger than the curvature in right-left direction as shown in FIG. 7(*c*), it is possible to radiate light horizontally over a wide range while making clear lightness and darkness in the upper and lower sides. Thus, it is possible to illuminate, for example, a pedestrian in a deep side of the walking path and a shoulder of the oncoming lane, so that a more preferable light distribution for the headlight can be formed.

When a convex lens in a semicircular-column shape as shown at FIG. 7(*d*) that has a convex-lens effect only in up-down direction is used as a radiation-side convex lens 2*a*-3, although it is unable in up-down direction to form a light distribution with inclination for illuminating up to a higher position in the walking path-side like the case of FIG. 7(*c*), it is possible in right-left direction to form a light distribution for the headlight that illuminates over a range wider than that in the case of FIG. 7(*c*).

Note that, although a convex lens with an elliptical shape is shown at FIG. 7(*c*), this elliptical shape is shown for just illustrating that a curvature in up-down direction and a curvature in right-left direction are different to each other, and it is not problematic if an unwanted portion thereof is eliminated as shown in FIG. 7(*b*). Thus, so long as the convex lens has a lens face in which the curvature in up-down direction and the curvature in right-left direction are different to each other, it is unnecessary to pay a lot of attention to its outer shape.

Likewise, with respect also to the standard convex lens at FIG. 7(*a*), it is not problematic if its outer shape is quadrangular, for example, and thus, the outer shape is unnecessary to be a circular shape.

Further, the convex lens with an elliptical shape shown at FIG. 7(*c*) and the convex lens in a semicircular-column shape shown at FIG. 7(*d*) are shaped to be circularly curved in their shorter directions; however, they may be shaped to be circularly curved in their longer directions. Furthermore, it is allowable to form a fine unevenness on the surface to thereby blur the illumination light.

Further, while, as convex lenses, there are those of a type in which the convex face is spherical and a type in which it is non-spherical, the convex lens of either one of these types is usable as the radiation-side convex lens 2*a* or the LED-side convex lens 2*b*. Furthermore, while, as convex lenses, there are those of types in which both of front and back faces are convex faces, in which one of the faces is a convex face and the other is a flat face (for example, FIG. 7(*a*)), and in which one of the faces is a convex face and the other is a concave face or the like, the convex lens of any one of these types is usable as the radiation-side convex lens 2*a* or the LED-side convex lens 2*b*.

Moreover, as the radiation-side convex lens 2*a* or the LED-side convex lens 2*b*, a Fresnel lens is also usable.

Figure 9:
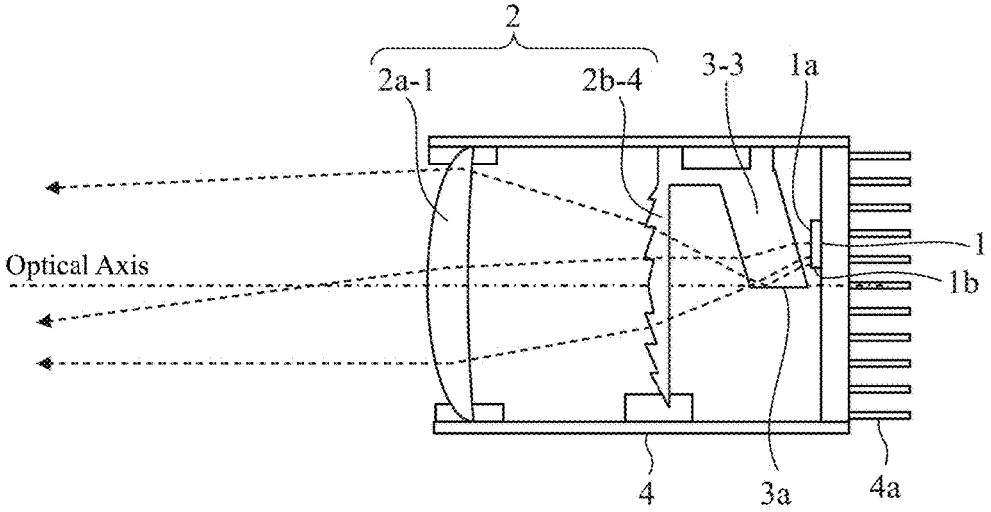
FIG. 9 is a side view showing another modified example of the optical system of the headlight for in-vehicle use according to Embodiment 1.

In FIG. 9, a configuration example of an optical system in which a Fresnel lens is used as an LED-side convex lens 2*b*-4 is shown. Because of providing the Fresnel lens as the LED-side convex lens 2*b*-4, a thick-walled portion at the center of the convex lens can be made thinner, to thereby save its weight and reduce its component unit price.

When a Fresnel lens is used as the radiation-side convex lens 2*a*, there may be a case that is inappropriate in design because concentric rings of the Fresnel lens can be seen through the front lens 6 at the time the headlight for in-vehicle use is viewed from the front; however, when it is used as the LED-side convex lens 2*b*-4, the rings cannot be seen through the front lens 6, so that there is no case of affecting the design in appearance of the vehicle.

Consequently, according to Embodiment 1, the headlight for in-vehicle use is configured to include: the LED 1 that has the light-emitting face 1*a* whose one edge side is formed as the linear portion 1*b* and placed at the side of the optical axis so that the center of the light-emitting face 1*a* is displaced from the optical axis; the radiation-side convex lens 2*a* and the LED-side convex lens 2*b* that are arranged in the direction of the optical axis to constitute the projection lens 2; and the light distribution member 3 that is placed between the LED 1 and the projection lens 2, that is formed using a transparent material and that has, on its inner surface, the reflection face 3*a* for reflecting the light emitted by the LED 1, so as to form a cut-off line at the projection-lens-side edge 3*b* of the reflection face 3*a*.

Because the projection lens 2 is thus constituted by the radiation-side convex lens 2*a* and the LED-side convex lens 2*b*, the focal distance becomes shorter and thus, the projection lens 2 and the LED 1 can be placed close to each other, so that, even if small-aperture lenses are used as the projection lens 2, it is possible to cause the light emitted by the LED 1 to effectively incident on the projection lens 2. Accordingly, it is possible to achieve a headlight for in-vehicle use that is small-sized but can produce a sufficient brightness. Furthermore, because a low-power LED 1 can be used and thus the power consumption can be lower, it is allowable to make smaller the heat dissipation member of the heat-dissipation and fixing member 4. This results in downsizing of the headlight for in-vehicle use.

Further, because the light distribution member 3 is formed using a transparent material and its inner surface is used as the reflection face 3*a*, a previously-described mirror finishing as in Patent Document 3 becomes unnecessary, so that an inexpensive headlight for in-vehicle use can be achieved with a simple configuration.

Further, according to Embodiment 1, the focal point F of the projection lens 2 as a set being formed by the radiation-side convex lens 2*a* and the LED-side convex lens 2*b*, is placed within a predetermined distance from the projection-lens-side edge 3*b* of the light distribution member 3, so that a headlight for in-vehicle use with an appropriate light distribution can be achieved.

Further, according to Embodiment 1, as shown in FIG. 5, the light distribution members 3-2, 3-3, 3-5, 3-6 are each configured to include: the incident face 3*c* which is facing toward the LED 1 and on which the light emitted by the LED 1 is incident; and the outgoing face 3*d* which is facing toward the projection lens 2 and through which the incident light goes out, wherein either one of the incident face 3*c* and the outgoing face 3*d*, or each of these faces, is inclined with respect to a plane perpendicular to the optical axis. In more detail, it is so configured that at least the incident face 3*d* is inclined to be more toward the projection lens 2 as a distance increases from the optical axis.

Thus, the light emitted by the LED 1 that is placed at a position apart from the optical axis, can be refracted at either one of the incident face 3*c* and the outgoing face 3*d*, or each of these faces, to be guided toward the optical axis. Thus, a light-emitting direction in which light is brightly emitted by the LED 1 can be directed to near a portion just below the cut-off line, so that a headlight for in-vehicle use can be achieved that radiates illumination light for passing light which is bright at just below the cut-off line.

Further, according to Embodiment 1, as shown in FIG. 6, it is so configured that the light distribution member 3-3 is fixed to the LED-side convex lens 2*b*. In addition, the light distribution member 3-3 and the LED-side convex lens 2*b* are formed using a same type of resin. Thus, the LED-side convex lens 2*b* and the light distribution member 3-3 can be fabricated using the same material by a common process, so that a component member therefrom can be achieved that is highly accurate in their mutual positions and is low in cost.

Note that, with respect not only to the light distribution member 3-3 but also to a light distribution member in another shape, it may be fixed likewise to the LED-side convex lens 2*b*.

Further, according to Embodiment 1, as shown in FIG. 8, it is so configured that, in either one or both of the radiation-side convex lens 2*a*-1 and the LED-side convex lens 2*b*-1, the portions C1, C2 (FIG. 6) where the light emitted by the LED 1 does not reach are eliminated, so that the lens differs in size between its upper side and its lower side from the optical axis. Thus, a small-sized headlight for in-vehicle use can be achieved.

Further, according to Embodiment 1, as shown in FIG. 7, it is so configured that either one or each of the lens faces of the radiation-side convex lens 2*a*-2, 2*a*-3 and the LED-side convex lens 2*b*-2, 2*b*-3, has a curvature in up-down direction and a curvature in right-left direction that are different to each other. By thus making a difference between the curvatures of the lens face to thereby make a difference between the refraction amounts of the projection lens 2 in up-down direction and right-left direction, a headlight for in-vehicle use with a more preferred light distribution can be achieved.

Further, according to Embodiment 1, as either one or each of the radiation-side convex lens 2*a* and the LED-side convex lens 2*b*, a non-spherical lens may be used. When a lens with an arbitrary optical property is used in this manner, a headlight for in-vehicle use with an appropriate light distribution can be achieved.

Further, according to Embodiment 1, as either one or each of the radiation-side convex lens 2*a* and the LED-side convex lens 2*b*, a Fresnel lens may be used. This allows the convex lens to become thinner and lighter, and to reduce its component unit price.

Further, according to Embodiment 1, as shown in FIG. 3 and FIG. 5, the light distribution members 3, 3-3, 3-6 are each configured into a shape in which, in the projection-lens-side edge 3*b* of the reflection face 3*a*, a portion in the oncoming lane-side is inclined downward. Thus, it is possible to achieve a headlight for passing light with a light distribution in which illumination light radiated ahead of a vehicle illuminates up to a higher position in the walking path-side but does not dazzle the driver driving an oncoming vehicle (does not illuminate an eye location of the driver).

Embodiment 2

Figure 10:
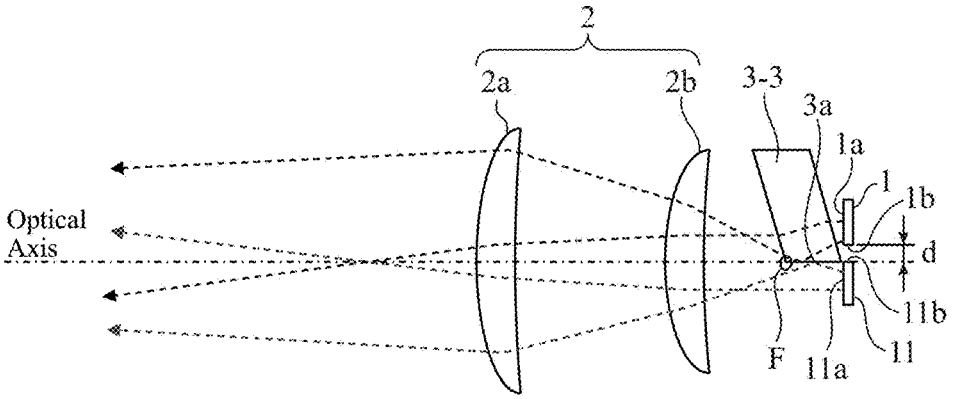
FIG. 10 is a side view showing a configuration example of an optical system of a headlight for in-vehicle use according to Embodiment 2 of the invention.

FIG. 10 is a diagram showing a configuration example of an optical system of a headlight for in-vehicle use according to Embodiment 2. In Embodiment 2, the LED 1 for passing light is placed in the upper side of the optical axis, and further, a second LED 11 for upper-side illumination is placed in the lower side of the optical axis. In more detail, the linear portion 1*b* in the lower side of the light-emitting face 1*a* of the LED 1 for passing light is placed apart by a separation interval d from the optical axis, and a linear portion 11*b* in the upper side of a light-emitting face 11*a* of the LED 11 for upper-side illumination is placed to be matched to the optical axis.

These LEDs 1, 11, radiation-side convex lens 2*a*, LED-side convex lens 2*b* and light distribution member 3-3 are fixed to the heat-dissipation and fixing member 4 shown in FIG. 1, and are accommodated in the casing 5 and the front lens 6, to provide the headlight for in-vehicle use.

Note that in FIG. 10, the same reference numerals are given to the same or equivalent parts in FIG. 1 to FIG. 9, so that their description is omitted here.

Figure 11:
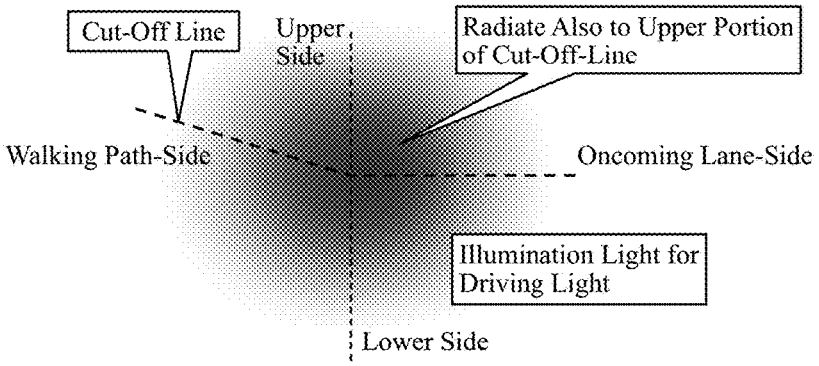
FIG. 11 is a diagram showing a condition of illumination light for driving light that is radiated from the headlight for in-vehicle use ahead of a vehicle.

FIG. 11 shows a condition of illumination light for driving light that is radiated ahead of a vehicle when the LED 1 for passing light and the LED for upper-side illumination are lighted at the same time, in which a bright portion of the illumination light is deeply depicted and a dark portion thereof is lightly depicted.

The lower side of a cut-off line is illuminated by the LED 1 for passing light placed in the upper side of the optical axis, and the upper side of the cut-off line is illuminated by the LED 11 for upper-side illumination placed in the lower side of the optical axis, so that a light distribution for driving light can be formed. By turning off the LED 11 for upper-side illumination while lighting the LED 1 only, it is possible to switch to the passing light shown in FIG. 2.

Note that the separation interval d is an interval that is reluctantly formed because, when the LED 11 for upper-side illumination is to be provided additionally to the LED 1 for passing light, the light-emitting face 1*a* of the LED 1 cannot be joined to the light-emitting face 11*a* of the LED 11 due to the electrodes for connection, etc. being placed on the edges of these LEDs 1, 11. Even with the separation interval d, as described in Embodiment 1, the light emitted by the LED 1 can be refracted to be guided toward the optical axis using the light distribution member 3-1, 3-3, 3-5 or 3-6 in FIG. 5. This is equivalent to placing the linear portion 1*b* on the optical axis by optically cancelling the separation interval d. Accordingly, in the illumination light for driving light, no dark portion corresponding to the separation interval d between the LEDs 1, emerges, so that it is possible to obtain preferred illumination light.

Although the light distribution member 3-3 is placed in the upper side of the optical axis in FIG. 10, it may inversely be placed in the lower side of the optical axis.

Figure 12:
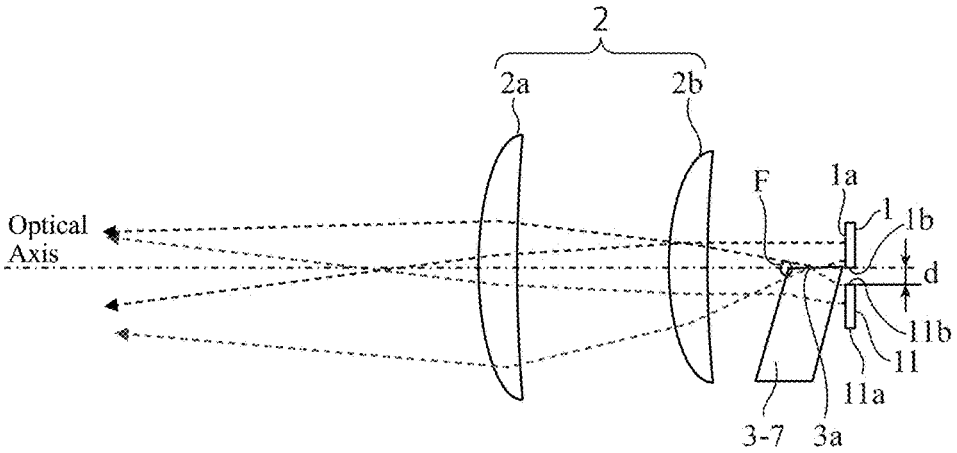
FIG. 12 is a side view showing a modified example of the optical system of the headlight for in-vehicle use according to Embodiment 2.

Here, such a modified example of the optical system is shown in FIG. 12. In FIG. 12, the linear portion 1*b* in the lower side of the light-emitting face 1*a* of the LED 1 for passing light is placed to be matched to the optical axis, and the linear portion 11*b* in the upper side of the light-emitting face 11*a* of the LED 11 for upper-side illumination is placed apart by the separation interval d from the optical axis. Further, in the lower side of the optical axis, a light distribution member 3-7 having a shape inclined to become more toward the projection lens 2 as a distance from the optical axis increases is placed, so that the separation interval d is optically cancelled to thereby equivalently place the linear portion 11*b* of the LED 11 for upper-side illumination on the optical axis. This makes it possible to obtain preferred illumination light when the LED 1 for passing light and the LED 11 for upper-side illumination are lighted at the same time, without emergence of a dark portion corresponding to the separation interval d in the illumination light for driving light. Note that, the inner side of the reflection face 3*a* of the light distribution member 3-7 reflects the light emitted by the LED 11 for upper-side illumination, whereas the outer side of the reflection face 3*a* reflects the light emitted by the LED 1 for passing light.

As shown in FIG. 10, when the light emitted by the LED 1 for passing light passes through the light distribution member 3-3, because of the refraction index of the light distribution member 3-3, the distance between the LED 1 and the projection lens 2 becomes as if it were apparently shorter, so that the light emitted by the LED 1 is efficiently guided to the LED-side convex lens 2*b* and thus, bright light is radiated ahead of the vehicle. In contrast, as shown in FIG. 12, when the light emitted by the LED 1 does not pass through the light distribution member 3-7, the LED 1 and the projection-lens-side edge 3*b* of the reflection face 3*a* do not become closer to each other, so that an influence by unevenness of the light emitted by the LED 1 is mitigated, and thus a clear cut-off line is radiated. Accordingly, it suffices to select either the configuration of FIG. 10 or FIG. 12, according to a demand for a light distribution of the illumination light.

Consequently, according to Embodiment 2, the headlight for in-vehicle use is so configured that the second LED 11 for upper-side illumination different to the LED 1 for passing light, is placed on the opposite side by which the optical axis is sandwiched, to thereby illuminate the upper side of the cut-off line. Thus, it is possible to achieve a headlight for in-vehicle use that is capable of radiating a light distribution for passing light by lighting only the LED 1, and radiating a light distribution for driving light by lighting both of the upper and lower LEDs 1, 11 at the same time, and thus that can light up the passing light or the driving light in a switched manner (that can work both for the passing light and for the driving light).

It should be noted that unlimited combination of the respective embodiments, modification of any configuration element in the embodiments and omission of any configuration element in the embodiments may be made in the present invention without departing from the scope of the invention.

INDUSTRIAL APPLICABILITY

As described above, the headlight for in-vehicle use according to the invention is configured to efficiently project the light emitted by an LED ahead of a vehicle using two convex lenses and a transparent light distribution member for forming a cut-off line, so that it is suited to be used as a headlight for passing light or the like.

DESCRIPTION OF REFERENCE NUMERALS AND SIGNS

1, 11: LED, 1*a*, 11*a*: light-emitting face, 1*b*, 11*b*: linear portion, 2: projection lens, 2*a*, 2*a*-1 to 2*a*-3: radiation-side convex lens, 2*b*, 2*b*-1 to 2*b*-4: LED-side convex lens, 3, 3-1 to 3-7: light distribution member, 3*a*: reflection face, 3*b*: projection-lens-side edge, 3*b*-1: horizontal portion, 3*b*-2: inclined portion, 3*c*: incident face, 3*d*: outgoing face, 4: heat-dissipation and fixing member, 4*a*: heat-dissipation fin, 5: casing, 6: front lens.

The invention claimed is:

1. A projector-type headlight for in-vehicle use that radiates light emitted by an optical source, ahead of a vehicle using a projection lens, comprising:

an LED (light Emitting Diode) that constitutes the optical source and has a light-emitting face whose one edge side is linearly formed and placed at a side of an optical axis so that a center of the light-emitting face is displaced from the optical axis;

two convex lenses that are arranged in a direction of the optical axis to constitute the projection lens; and a light distribution member that is placed between the LED and the projection lens, that is formed using a transparent material and that has, on its inner surface, a reflection face for reflecting the light emitted by the LED, so as to form a cut-off line at an edge in a side of the projection lens, of the reflection face.

2. The headlight for in-vehicle use of claim 1, wherein a focal point in a side of the LED, of the projection lens as a set being formed of the two convex lenses, is placed within a predetermined distance from the edge in the side of the projection lens, of the light distribution member.

3. The headlight for in-vehicle use of claim 1, wherein the light distribution member has:

an incident face facing toward the LED, on which the light emitted by the LED is incident; and an outgoing face facing toward the projection lens, through which the incident light goes out to the projection lens;

wherein either one of the incident face and the outgoing face, or each of these faces, is inclined with respect to a plane perpendicular to the optical axis.

4. The headlight for in-vehicle use of claim 3, wherein the incident face of the light distribution member is inclined to be more toward the projection lens as a distance increases from the optical axis.

5. The headlight for in-vehicle use of claim 1, wherein the light distribution member is fixed to the convex lens nearer to the LED in the two convex lenses constituting the projection lens.

6. The headlight for in-vehicle use of claim 1, wherein either one or each of the two convex lenses constituting the projection lens differs in size between its upper side and its lower side relative to the optical axis.

7. The headlight for in-vehicle use of claim 1, wherein either one or each of lens faces of the two convex lenses constituting the projection lens has a curvature in up-down direction and a curvature in right-left direction that are different to each other.

8. The headlight for in-vehicle use of claim 1, wherein a second LED different to the above LED is placed on an opposite side by which the optical axis is sandwiched.

9. The headlight for in-vehicle use of claim 1, wherein either one or each of the two convex lenses constituting the projection lens is an aspherical lens.

10. The headlight for in-vehicle use of claim 1, wherein either one or each of the two convex lenses constituting the projection lens is a Fresnel lens.

11. The headlight for in-vehicle use of claim 1, wherein the light distribution member has a shape in which, in the edge in the side of the projection lens of the reflection face, a portion in a driving lane-side is inclined downward.

12. The headlight for in-vehicle use of claim 1, wherein the projection lens and the light distribution member are formed of a same type of resin.

* * * * *